US008752404B2

(12) United States Patent
Oertel et al.

(10) Patent No.: US 8,752,404 B2
(45) Date of Patent: Jun. 17, 2014

(54) DRUM FOR A LAUNDRY TREATMENT MACHINE

(75) Inventors: Christoph Oertel, Haan-Gruiten (DE); Uwe Ratfisch, Berlin (DE); Stephan Sommer, Falkensee (DE); Wilfried Wildung, Berlin (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 1006 days.

(21) Appl. No.: 12/863,013

(22) PCT Filed: Jan. 2, 2009

(86) PCT No.: PCT/EP2009/050002

§ 371 (c)(1),
(2), (4) Date: Jul. 15, 2010

(87) PCT Pub. No.: WO2009/090107

PCT Pub. Date: Jul. 23, 2009

(65) Prior Publication Data

US 2011/0048080 A1 Mar. 3, 2011

(30) Foreign Application Priority Data

Jan. 16, 2008 (DE) ..... 10 2008 004 661

(51) Int. Cl.
*D06F 21/00* (2006.01)
*D06F 23/00* (2006.01)
*D06F 25/00* (2006.01)

(52) U.S. Cl.
USPC ..... 68/142; 68/3 R

(58) Field of Classification Search
USPC ..... 68/12.19, 19, 23 R, 24, 30, 43, 50, 139, 68/142, 143; 34/58, 108, 109
See application file for complete search history.

(56) References Cited

U.S. PATENT DOCUMENTS

| | | | | |
|---|---|---|---|---|
| 1,563,522 | A | 12/1925 | Butzbach | |
| 5,881,909 | A * | 3/1999 | Crain et al. | 220/676 |
| 2005/0229647 | A1 * | 10/2005 | Kim et al. | 68/20 |
| 2005/0283920 | A1 * | 12/2005 | Wittemann | 8/158 |
| 2009/0211313 | A1 | 8/2009 | Exler et al. | |

FOREIGN PATENT DOCUMENTS

| | | | | |
|---|---|---|---|---|
| DE | 70397 | | 9/1892 | |
| DE | 1174738 | | 7/1964 | |
| DE | 3544808 | A1 * | 6/1987 | D06F 37/06 |
| DE | 29705226 | U1 | 9/1998 | |
| DE | 19951743 | A1 | 5/2001 | |
| DE | 102006010179 | A1 | 7/2007 | |
| EP | 866161 | A2 * | 9/1998 | |
| JP | 01020898 | A * | 1/1989 | D06F 37/08 |
| WO | WO 2007077075 | A1 * | 7/2007 | D06F 37/04 |

* cited by examiner

*Primary Examiner* — Jason Ko
(74) *Attorney, Agent, or Firm* — Nixon & Vanderhye, P.C.

(57) ABSTRACT

A drum for a laundry treatment machine that is rotatably mounted within the housing of the laundry treatment machine, and wherein the drum includes a bottom disk and a jacket which are individually or jointly provided with a curved structure. The curved structure includes at least two rows of prism-type embossings that have substantially rectangular base, and the at least two rows encompass at least partially the drum. A surface of embossings that is directed in a circumferential direction of the drum is arranged at a steep angle to the jacket; an opposing surface of the embossings is arranged at a flat angle to the jacket; and lateral surfaces of the embossings are arranged at least nearly at a right angle to the jacket.

21 Claims, 4 Drawing Sheets

DRUM FOR A LAUNDRY TREATMENT MACHINE

BACKGROUND OF THE INVENTION

The invention relates to a drum for a laundry treatment machine, with the drum being rotatably mounted within the housing of the laundry treatment machine and having at least one bottom disk and a jacket, which are individually or jointly provided with a curved structure.

A drum of this type is known from DE 10 2006 010 179 A1. Individual elements with a curved structure are arranged therein in the drum jacket in a line along the circumferential direction in each instance, the contour of which extending in the alignment of the drum jacket forms a surface with several arched borders which extend continuously into one another and has only one single axis of symmetry, which runs at least approximately in the circumferential direction of the drum jacket. Flood holes are attached to the wall parts of the elements which rise the most relative to the cover of the drum jacket, by means of which an exchange between the interior of the drum and its surroundings can take place.

DE-PS 70 397 and DE-AS 1 174 738 describe laundry drums, the drum jackets of which have ridges and/or ribs perpendicular to the circumferential direction. This inner structure which is formed as a result is to emulate the effect of a washboard, with the use of which the laundry was rubbed manually over the wave structure. This effect can assist with the mechanical treatment of the laundry; it is thus approved by laundry experts. The drum known from DE 10 2006 010 179 A1 cannot illustrate this effect to an adequate degree, because the number of elements is too small for this purpose. On the other hand, a drum jacket with a purely wave and/or rib-type structure is not sufficiently stable and also represents a significant problem from a manufacturing-specific point of view, because a jacket plate with a wave or rib-type structure can only be connected to the bottom of the drum with considerable difficulty.

BRIEF SUMMARY OF THE INVENTION

The object underlying the invention is therefore to combine the advantages of the suggestions from the prior art with one another such that a different effect which is dependent on the direction of rotation can be achieved, that the flood holes can be arranged and distributed in a way that is more gentle to the laundry and that the structure also has an inherent scooping effect which allows water to be scooped from an amount of water stored at the bottom of the lye container when the drum rotates and be conveyed onto the laundry from above.

In accordance with the invention, the curved structure consists of at least two rows of prism-type embossings, which at least partially encompass the drum and have a substantially rectangular base, from which the surface oriented in the circumferential direction of the drum extends at a steep angle while the opposite surface extends at a flat angle relative to the drum jacket and from which the lateral faces extend at least nearly at 90 degrees from the jacket. Such prism-type embossings, which are embossed into the jacket plate in tight rows upstream and adjacent to one another, emulate convincing washboard wave structures of the prior art to the customer, can be very easily implemented by means of an embossing press and are significantly involved in the required washing mechanism by virtue of their multiplicity. The different steepness of the prism surfaces improves the laundry distribution within the drum and the drainage of the laundry during the spinning process; since the active surfaces are separate from one another: The flat, unpunched surface provides for the drainage with the high laundry contact pressure and the steep, punched surface provides for a good and unimpeded water drainage. The enhanced scooping effect can reduce the water level at the bottom of the surrounding lye container, as a result of which the so-called dead liquor is reduced. Finally, it is also evident that the new structure gives the overall drum a greater rigidity.

Depending on structural framework conditions, the embossings can form a structure which curves onto the exterior or onto the interior of the jacket. As the embossings are in any case manufactured prior to rolling the drum jacket, the embossings can essentially be configured the same. Provided the drum is used in a laundry treatment machine which carries liquid, it is only the flood holes that should be directed from the interior to the exterior.

The decision relating to the dimensions and the arrangements of the individual embossings relative to one another must likewise be subject to the structural framework conditions, which are to be attuned to the process flows of the laundry treatment process. For instance, the width of the rectangular base corresponds approximately to its length or double the length etc. The adjacent rows can also be offset relative to one another such that adjacent embossings do not correspond to one another. The mixed usage of embossings with different dimensions, which are to be even relative to one another in order to obtain the desired rib structure, can be considered. The features described in the subclaims can be used together with those of claim 1, individually or jointly, in each possible combination without departing from the shared inventive ideas.

BRIEF DESCRIPTION OF THE DRAWINGS

On the basis of the exemplary embodiments shown in the drawing, the invention is described below, in which;

FIG. 2 shows the ratio of the drum rotation to the lye flow, with the aid of a section proceeding along the circumferential direction through the drum jacket, with a structure embossed from the outside in.

DETAILED DESCRIPTION OF EXEMPLARY EMBODIMENTS OF THE PRESENT INVENTION

Figure 1:
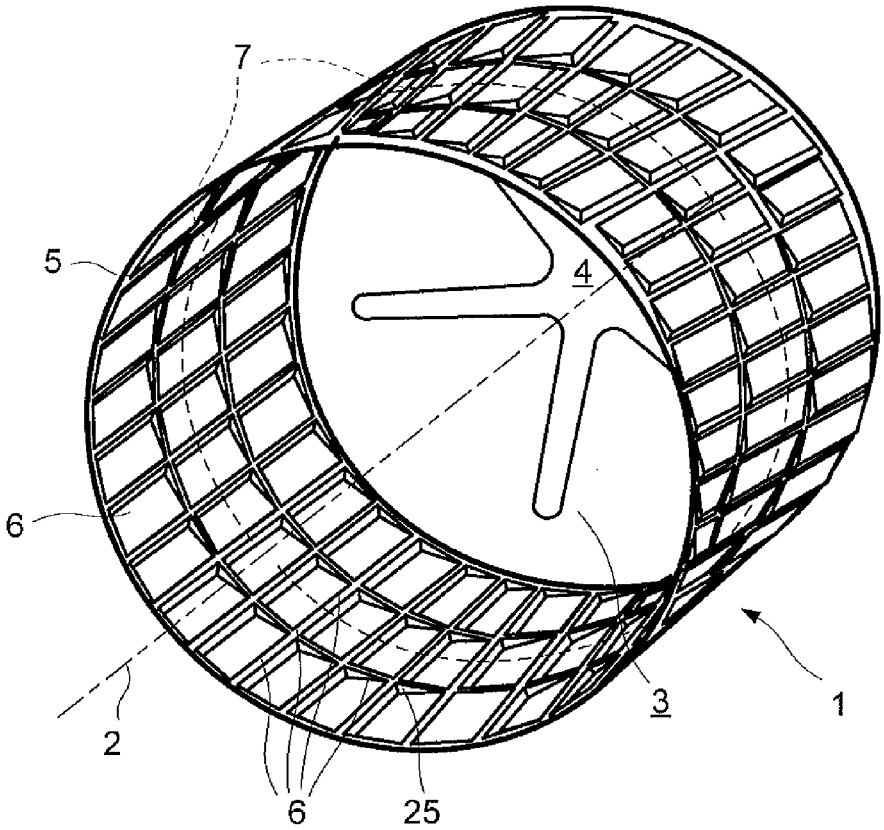
FIG. 1 shows a laundry drum of a laundry treatment machine having three rows of prism-type elements embossed in the drum jacket from the inside out.

The laundry drum 1 shown in FIG. 1 is shown isolated outside the assigned laundry treatment machine, in which it could rotate about an axis 1, and contains a bottom disk 3, with which the drum can be fastened in the laundry treatment machine by means of a drum star 4. The drum jacket 5 is fastened to the bottom disk 3 in a known manner, and supports three peripheral rows of embossings 6. As no flood holes can be seen on the drum jacket 5, this drum could be provided for a laundry treatment machine, the treatment processes of which are not implemented with liquid. The dashed arcs 7 identify a circumferential line of the drum.

Figure 2:
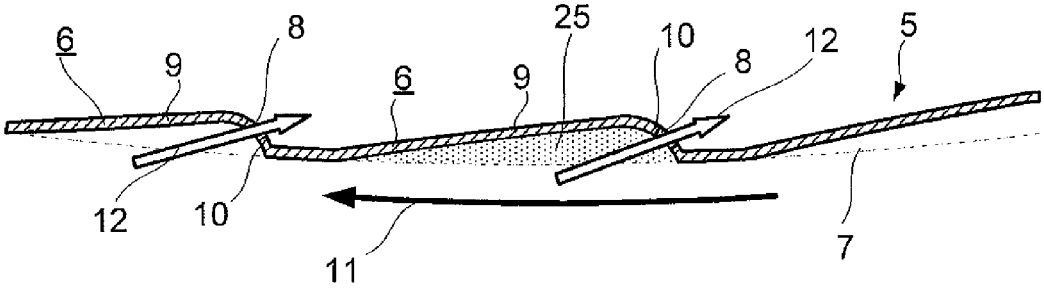
Figure 3:
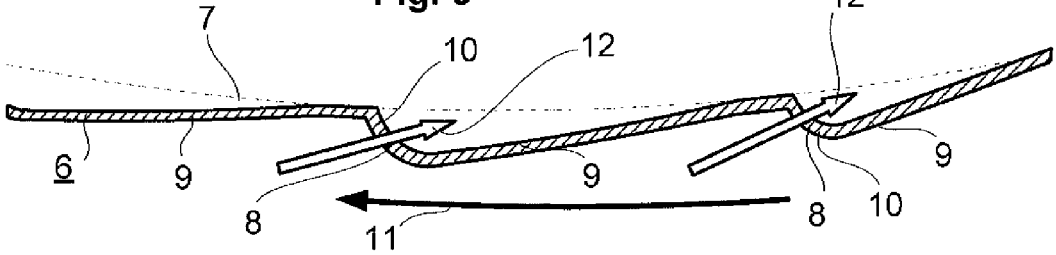
FIG. 3 shows the drum rotation and lye flow according to FIG. 2 with a structure embossed from the inside out.

The sections shown in FIGS. 2 and 3 run along such a circumferential line 7 through the drum jacket 5, which is provided with flood holes 8 in these examples for laundry treatment processes implemented with liquid, said flood holes being disposed in the steep edges 10 of the prismatic embossings 5. The transitions between the steep (10) and the flat edges 9 are reproduced here in a very rounded form. They can however also be more sharp-edged like the representation in FIG. 1. With the rotational direction 11 of the drum, the inwardly directed embossings 6 scoop a large quantity of water (arrow 12) through their flood holes 8. In the opposite rotational direction of the drum, water, in a minimal quantity at a normal treatment speed, escapes here again in a significant quantity at spinning speed (opposite to the arrow direction 12). The embossings 5 also have lateral faces 25, which are also at least approximately at right angles to the drum jacket 5. FIG. 2 shows these lateral faces 25 of an embossing 5 by means of a squared grid.

With the drum shown in FIG. 3, the embossings 5 of which are shown outwards, the ratios of the drum rotation 11 and the water flow 12 reverse.

Figure 4:
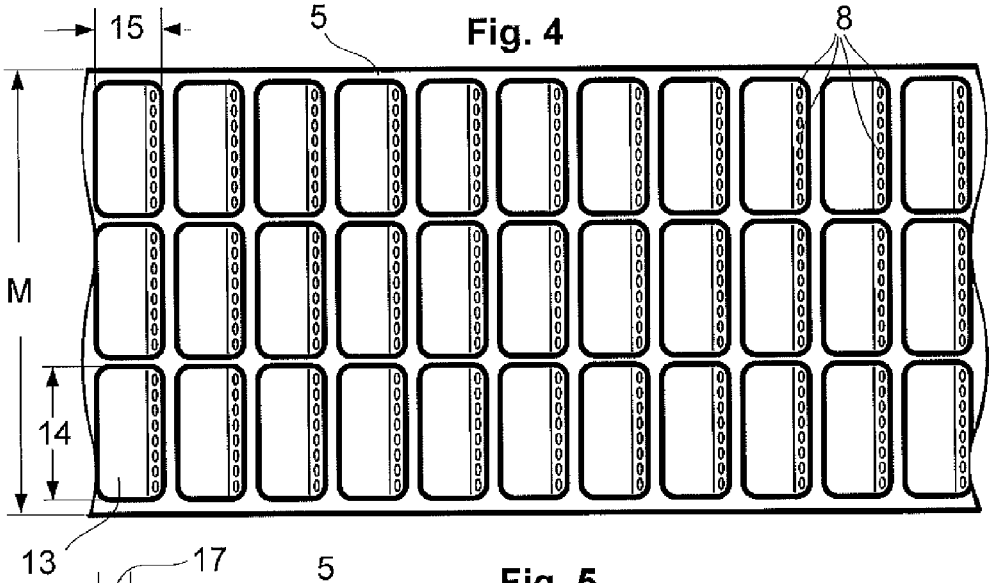
FIG. 4 shows a section of a drum jacket prior to rolling relative to a cylinder with embossings in a ratio of width (dimensions parallel to the drum axis) to the length (dimension in the circumferential direction) of the rectangular base of 2:1 when distributing three rows of embossings over the entire width of the drum jacket.

The drum jacket section shown in FIG. 4 shows embossings 13 with a ratio of edge lengths of its rectangular base of 2:1, corresponding to the width 14 (parallel to the drum axis 2) in relation to the length 15 (in the circumferential direction). With embossings 13 of this size, there is only room for three rows next to one another on the drum jacket M.

Figure 5:
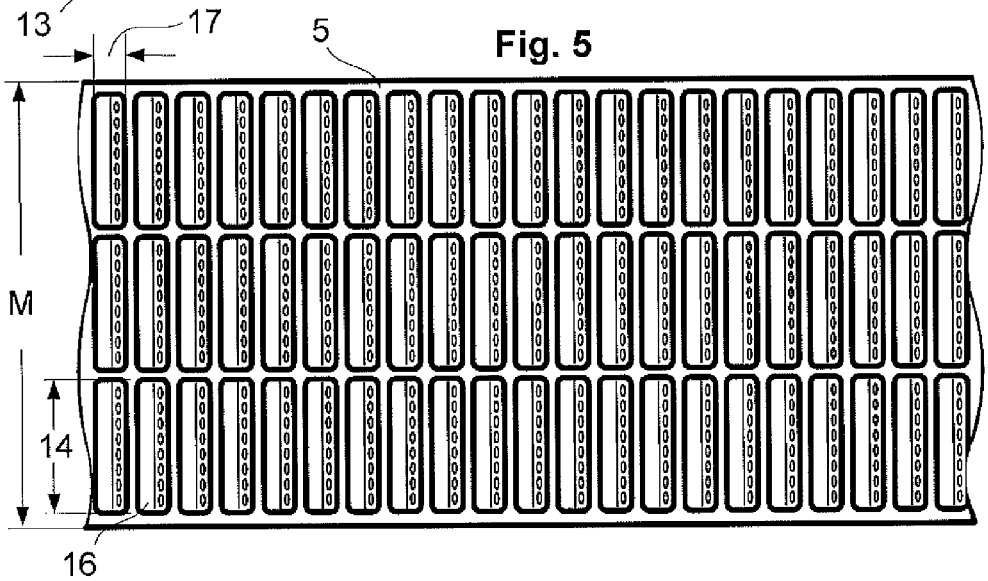
FIG. 5 shows a section according to FIG. 4 with an aspect ratio of 4:1 and similarly three rows of embossings.

The section in FIG. 5 likewise has embossings 16 of width 14. These are however only half as long (length 17) relative to the embossings 13 in FIG. 4. Its aspect ratio is therefore between 4 and 5:1. From this form of embossings 16, three rows likewise run across the width M of the drum jacket 5.

Figure 6:
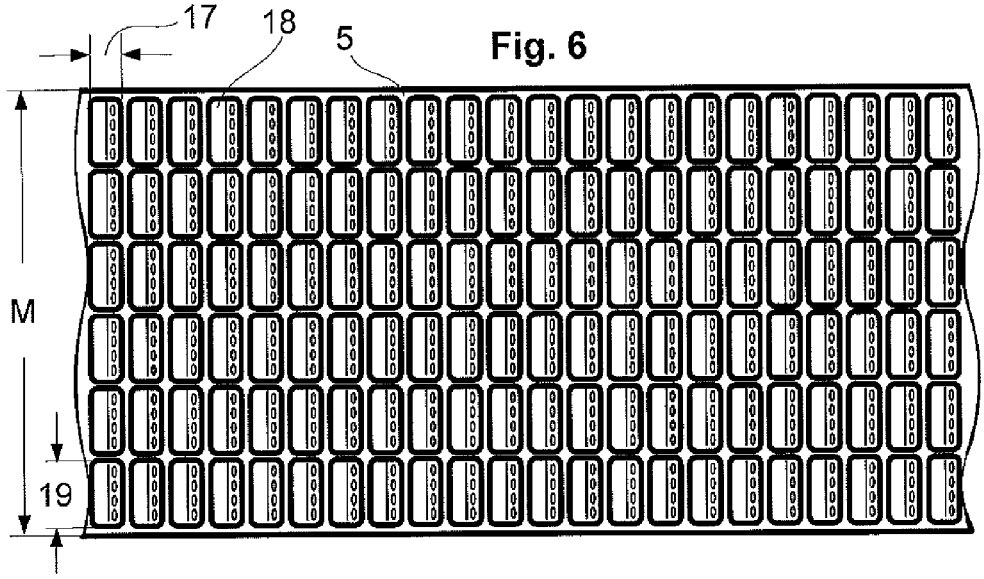
FIG. 6 shows a section according to FIG. 4 with an aspect ratio of 2:1 and six rows of embossings.

Six rows of embossings 18 run over the width M of the drum jacket 5 in FIG. 6, similarly these have the length 17 as in FIG. 5 but a width 19, which is only half as great as that in FIGS. 4 and 5. The aspect ratio is therefore similar to FIG. 4—2:1. Furthermore, embossings are also possible of which the width and length at least approximately correspond. With sufficiently small widths, one can even accommodate 12 or more rows of embossings in the drum jacket 5.

Figure 7:
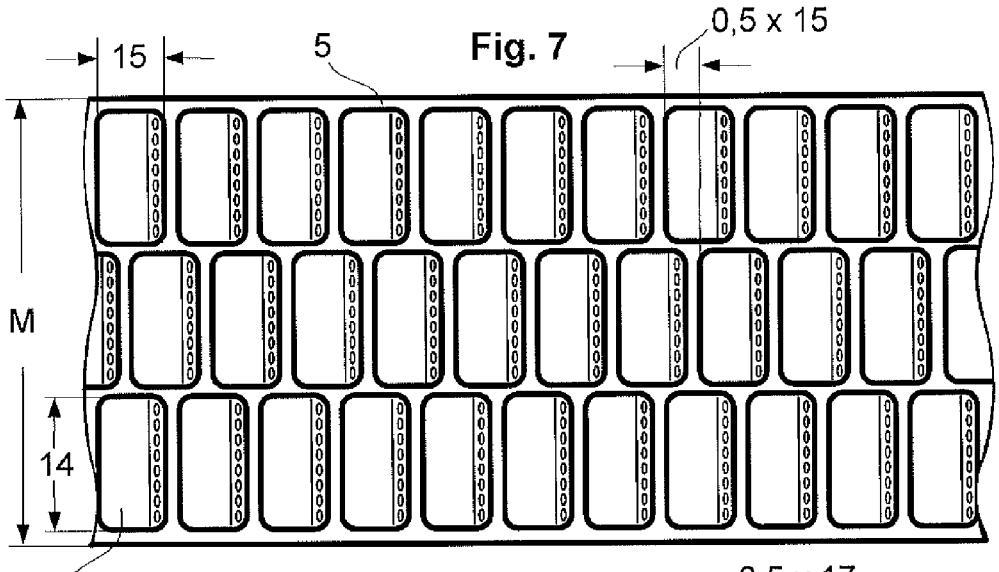
FIG. 7 shows a section according to FIG. 4, in which the adjacent embossings are offset by a half length relative to one another.
Figure 8:
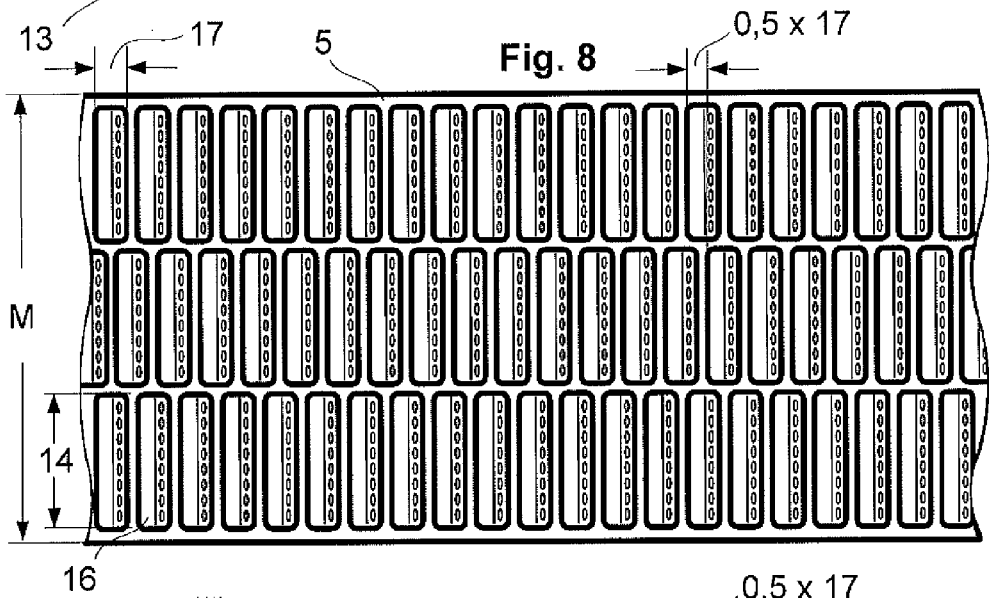
FIG. 8 shows a section according to FIG. 5, in which the adjacent embossings are offset by a half length relative to one another
Figure 9:
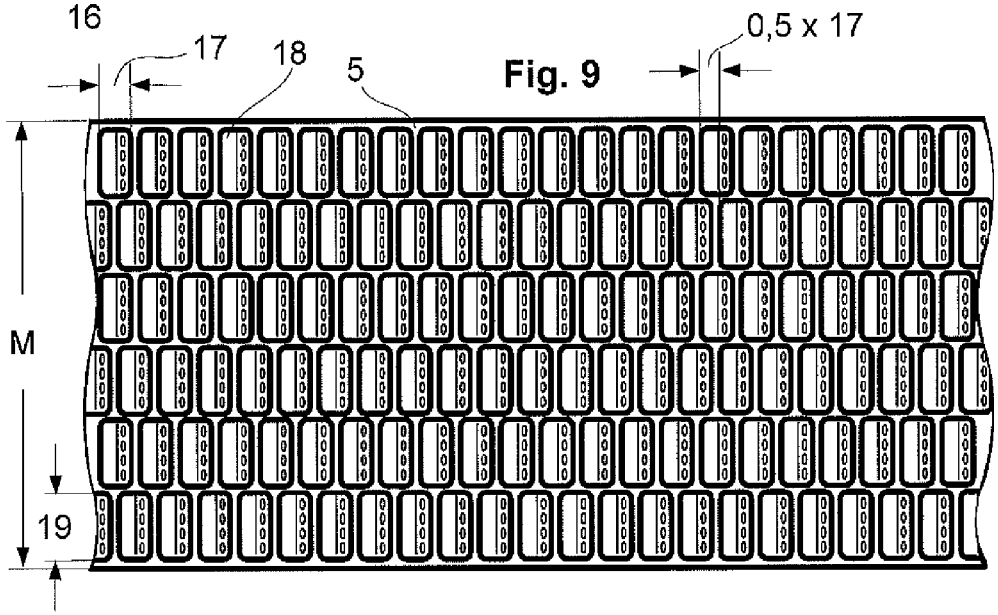
FIG. 9 shows a section according to FIG. 7, in which the adjacent embossings are offset by a half length relative to one another.

When rolling a drum jacket strip in the examples in accordance with FIGS. 4 to 6, buckling is likely to occur in the drum jacket 5 unless special measures are taken, and this will occur precisely at the intermediate spaces between two consecutive embossings of a row. To attenuate and/or completely eliminate this risk, the smallest possible embossings are chosen, therefore many adjacent to one another, and are offset row by row. The examples in FIGS. 7 to 9 are suited hereto, which otherwise comprise the same features as the example in FIGS. 4 to 6. In the examples in FIGS. 7 to 9, the offset, e.g. 0.5×15, is a half embossing length 15 and/or 17. One can choose the offset also to be smaller, e.g. a third of the length 15, if three rows are accommodated on the jacket width M, or a sixth, if six rows are accommodated on the jacket width M. The fraction of the length must however not have any proportionality to the number of rows. The smaller the offset between the rows, the less the tendency of the drum jacket 5 to buckle when the cylinder is being molded.

Figure 10:
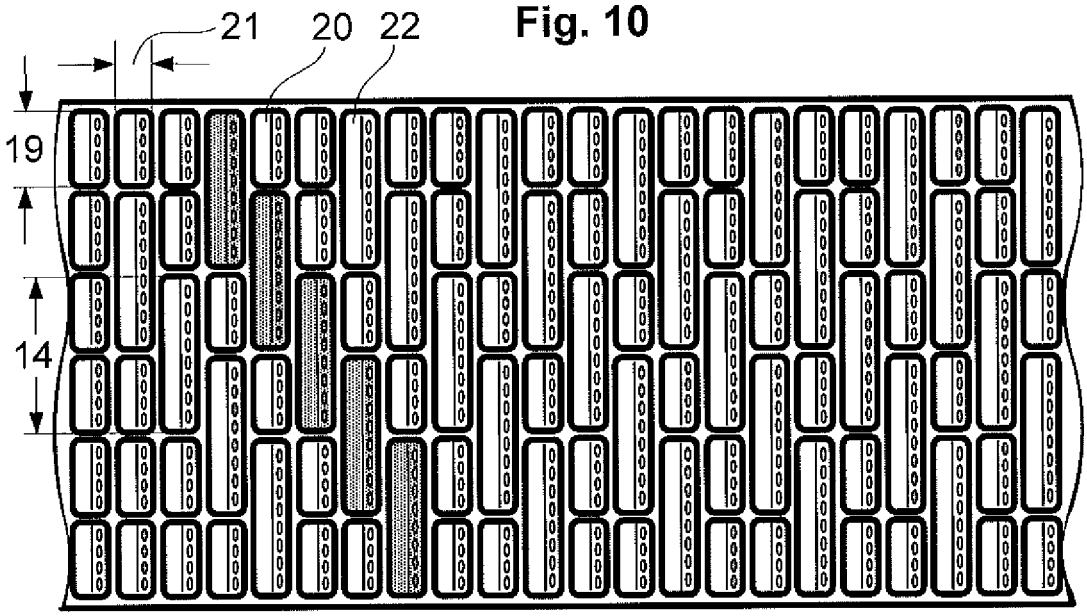
FIG. 10 shows a section according to FIG. 6, in which embossings with different aspect ratios are arranged in a mixed fashion.

In the example in FIG. 10, no offset of the rows relative to one another is possible, but the buckling tendency can also be reduced by sufficiently long lengths 21 of embossings 20 and 22. The example in FIG. 10 is also characterized by a further special feature. The embossings are not all of equal widths. Embossings 20 have, relative to their length 21, twice as large a width 19. Embossings 22 are however arranged inbetween, the width 14 of which amounts to four times their length 21. The additional special feature in this example is that these wider embossings 22 are likewise arranged regularly such that when rotating the drum, the laundry rolling inside is moved in the direction of the regular offset of the additional embossing 22 in the parallel direction to the drum axis. To illustrate this regular offset, a series of embossings 22 (extending at right angles across the rows) is shown with a squared grid. This can be used to move the laundry preferably toward the drum opening or against the drum bottom.

Other combinations of embossings with different dimensions and proportions are naturally also possible. Mixtures of various embossings are possible here, which allow an offset in the peripheral direction and also a series of identical embossings which extend at right angles across the rows. Advantageous effects can also be achieved by mixtures of embossings, which are disposed in different directions. Different mechanical effects can be achieved for instance in combination with different types of embossings of the drum jacket, e.g. by differently molded laundry agitators, in specific drum regions, it being possible to still support said mechanical effects by different rotational drum directions in each instance.

The invention claimed is:

1. A drum for a laundry treatment machine, the drum being rotatably mounted within a housing of the laundry treatment machine, and the drum comprising:

at least one bottom disk;

a jacket, the jacket provided with a curved structure;

wherein the curved structure includes at least two rows of prism-type embossings having a substantially rectangular base;

wherein the at least two rows at least partially encompass the drum;

wherein a surface of the prism-type embossings that is directed in a circumferential direction of the drum is arranged at a steep angle to the jacket;

wherein an opposing surface of the prism-type embossings is arranged at a flat angle to the jacket; and wherein lateral surfaces of the prism-type embossings are arranged at least nearly at a right angle to the jacket.

2. The drum of claim 1, wherein the prism-type embossings protrude from an exterior of the jacket.

3. The drum of claim 1, wherein the prism-type embossings protrude from an interior of the jacket.

4. The drum of claim 1, wherein the laundry treatment machine carries a liquid, and wherein the surface of the prism-type embossings that is arranged at a steep angle to the jacket contains flood holes.

5. The drum of claim 1, wherein a width of the substantially rectangular base approximately equals a length of the substantially rectangular base.

6. The drum of claim 1, wherein a width of the substantially rectangular base approximately equals twice a length of the substantially rectangular base.

7. The drum of claim 1, wherein a width of the substantially rectangular base approximately equals four to five times a length of the substantially rectangular base.

8. The drum of claim 1, wherein three to twelve rows of the prism-type embossings are arranged over a width of the jacket, depending on a width of the substantially rectangular base.

9. The drum of claim 1, wherein the at least two rows are arranged around a circumference of the drum such that adjacent ones of the prism-type embossings are flush with one another.

10. The drum of claim 1, wherein the at least two rows are arranged around a circumference of the drum such that adjacent ones of the prism-type embossings are offset relative to one another.

11. The drum of claim 1, wherein the rectangular base has a length and a width and the longest of the length and the width is perpendicular to the circumferential direction.

12. The drum of claim 11, wherein each of the prism-type embossings is aligned along a first edge in axial rows and along a second edge in circumferential rows, and the first edge defines the length, and second edge defines the width.

13. The drum of claim 1, wherein each of the prism-type embossings is aligned along a first edge in axial rows and along a second edge in circumferential rows, and the first edge defines the length, and second edge defines the width.

14. A drum rotatably mounted within a housing of a laundry treatment machine, the drum comprising:

a bottom disk;

a cylindrical jacket joined to the bottom disk; and at least two rows of prism-type embossings having a substantially rectangular base, the at least two rows being disposed circumferentially on the cylindrical jacket, wherein a first surface of each of the prism-type embossings faces in a circumferential direction of the drum and is arranged at a first angle to the jacket, a second surface of each of the prism-type embossings opposes the first surface and is arranged at a second angle to the jacket, the first angle being greater than the second angle; and circumferentially aligned surfaces of each of the prism-type embossings are arranged at substantially a right angle to the jacket.

15. The drum of claim 14, wherein the prism-type embossings protrude from an exterior of the jacket.

16. The drum of claim 14, wherein the prism-type embossings protrude from an interior of the jacket.

17. The drum of claim 14, wherein the laundry treatment machine carries a liquid, and wherein the first surface contains flood holes.

18. The drum of claim 14, wherein the rectangular base has a length and a width and the longest of the length and the width is perpendicular to the circumferential direction.

19. The drum of claim 18, wherein each of the prism-type embossings is aligned along a first edge in axial rows and along a second edge in circumferential rows, and the first edge defines the length, and second edge defines the width.

20. The drum of claim 14, wherein each of the prism-type embossings is aligned along a first edge in axial rows and along a second edge in circumferential rows, and the first edge defines the length, and second edge defines the width.

21. A drum rotatably mounted within a housing of a laundry treatment machine, the drum comprising:

a bottom disk;

a cylindrical jacket joined to the bottom disk; and at least two rows of embossings having a substantially rectangular base, the at least two rows being disposed circumferentially on the cylindrical jacket, wherein a first surface of each of the embossings faces in a circumferential direction of the drum and is arranged at a first angle to the jacket, a second surface of each of the embossings opposes the first surface and is arranged at a second angle to the jacket, the first angle being greater than the second angle; and two opposing surfaces of each of the embossings facing in opposite axial directions of the drum are arranged at substantially a right angle to the jacket.

* * * * *